United States Patent [19]

Raymond et al.

[11] Patent Number: 4,765,663

[45] Date of Patent: Aug. 23, 1988

[54] SPRING-LOADED DEAD BOLT ASSEMBLY

[75] Inventors: James W. Raymond, Newport Beach; James A. Millett, Costa Mesa, both of Calif.

[73] Assignee: Winfield Locks, Inc., Costa Mesa, Calif.

[21] Appl. No.: 342,144

[22] Filed: Jan. 25, 1982

[51] Int. Cl.[4] ..... F05C 1/08

[52] U.S. Cl. ..... 292/169.13; 292/335; 292/333

[58] Field of Search ..... 292/169.13, 333, 335, 292/191, 192

[56] References Cited

U.S. PATENT DOCUMENTS

| | | | |
|---|---|---|---|
| 600,584 | 3/1898 | Kaye | 292/333 X |
| 970,628 | 9/1910 | Leistler | 292/335 X |
| 2,854,270 | 9/1958 | Ward | 292/169.13 X |
| 4,262,504 | 4/1981 | Inoue | 292/333 X |

FOREIGN PATENT DOCUMENTS

| | | | |
|---|---|---|---|
| 135726 | of 1927 | Australia | 292/335 |
| 75175 | 5/1894 | Fed. Rep. of Germany | 292/333 |
| 541556 | 1/1932 | Fed. Rep. of Germany | 292/333 |
| 376968 | 7/1932 | United Kingdom | 292/333 |
| 779563 | 11/1980 | U.S.S.R. | 292/169.13 |

*Primary Examiner*—Gary L. Smith
*Assistant Examiner*—Eric K. Nicholson
*Attorney, Agent, or Firm*—Keith D. Beecher

[57] ABSTRACT

A lock assembly is provided which contains a spring-loaded dead bolt and a spring-loaded plunger intercoupled to one another. The assembly is such that when the door is closed, the plunger is pushed in by the striker plate on the door frame, and this releases the spring-biased dead bolt and causes the dead bolt to be fully extended into the cavity in the striker plate. When that occurs, the linkage coupling the assembly to the doorknob moves to a position in which one of its members serves as a stop to prevent the dead bolt from being forced back to a retracted position until the doorknob is turned.

2 Claims, 2 Drawing Sheets

SPRING-LOADED DEAD BOLT ASSEMBLY

BACKGROUND OF THE INVENTION

Door locks are known to the prior art which include a latch bolt and a spring-biased plunger positioned adjacent to one another and spring-biased to an extended position. In the prior art assemblies, when the doorknob is turned, both the plunger and latch bolt are retracted together However, when the door is closed, the latch bolt is received in a cavity in the striker plate on the door frame, while the plunger is retracted by the striker plate. This causes the plunger to interlock with the latch bolt to restrain retraction of the latch bolt for security purposes.

The length of the latch bolt projecting from the edge of the door into the cavity in the striker plate is usually referred to as the "throw" of the latch bolt. Currently, the throw of a prior art latch bolt is of the order of one-half an inch. It has been found, however, that such a throw is not sufficient to render the door immune against its being forced open by jimmying action. It is clear that lengthening the throw of the latch bolt is desirable from the standpoint of security, because the longer the throw of the latch bolt, the more difficult it is to jimmy the door. However, there is a limit to the throw of the latch bolt because of the geometry of present-day locks, the manner in which present-day locks are mounted in the doors.

U.S. Pat. No. 3,891,255, which is assigned to the present assignee, discloses a latch bolt assembly for a door with an extensible latch bolt which makes it more difficult for the door to be jimmied open. In this manner, the problem discussed in the preceding paragraph may be solved.

The mechanism of the present invention also solves the problem in a somewhat similar manner and by a more rugged mechanism. This is achieved by providing a spring-biased plunger and a a spring-biased dead bolt and an intercoupling between the plunger and the dead bolt, so that when the plunger is retracted by the striker plate, it releases the dead bolt and causes the dead bolt to be moved by spring action from its retracted position into the cavity in the striker plate in which it assumes a fully extended position. When the foregoing action occurs, and the dead bolt assumes its fully extended position, a linkage mechanism in the assembly causes the dead bolt to be positively locked in its extended position against retraction until the doorknob is again turned, so that the dead bolt cannot be forced back to its retracted position.

The mechanism of the present invention eliminates any need for a latch, and accordingly, the mechanism is relatively simple and straightforward, and can be constructed at a relatively low cost. The mechanism itself is exceedingly rugged, and includes a mechanical stop member which serves to restrain the latch bolt firmly and securely, when the mechanism is in its locked position with the dead bolt extended.

Another advantage of the mechanism of the invention is that it can be fitted into doors with a minimum of alteration to the door itself, so as to replace existing key-in-knob or Mortise locks. Yet another advantage of the mechanism of the invention is that it causes the dead bolt to be actuated automatically whenever the door is closed, so that there is no need for the user to remember to throw the dead bolt. Also, the mechanism of the invention is contructed, as will be described, to minimize the effects of rough usage and abuse.

DETAILED DESCRIPTION OF THE ILLUSTRATED EMBODIMENT

Figure 3:
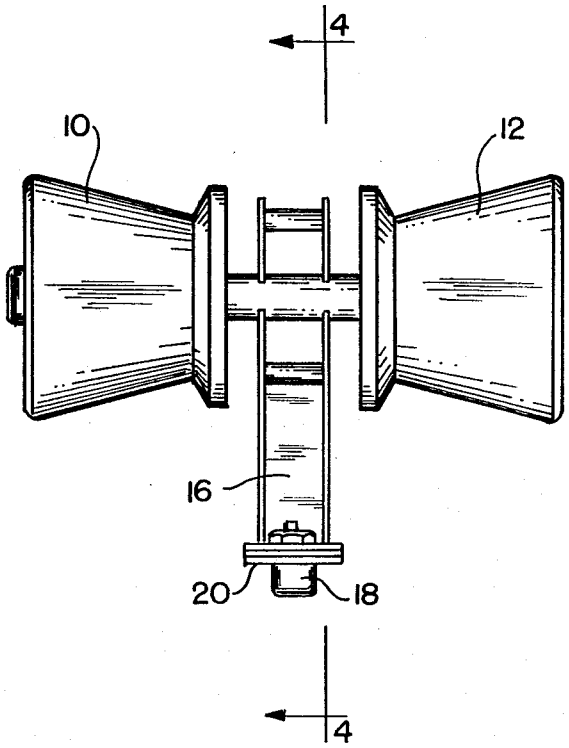
FIG. 3 is a top plan view of the assembly of FIG. 1.
Figure 2:
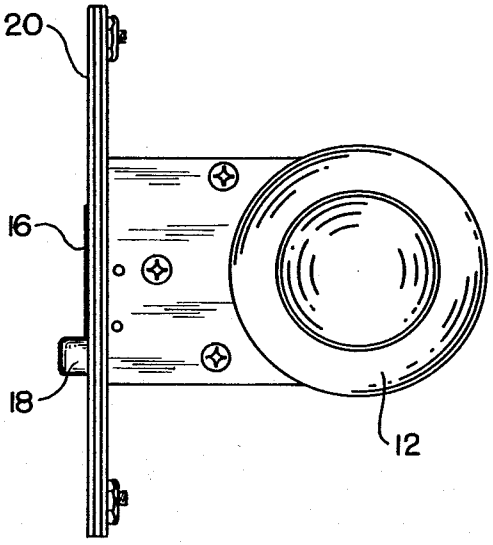
FIG. 2 is a side elevational view of the assembly of FIG. 1.
Figure 1:
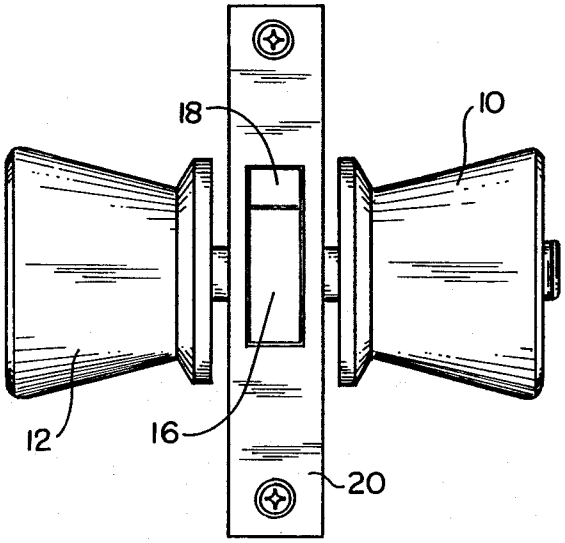
FIG. 1 is a front elevational view of a doorknob assembly incorporating the mechanism of the present invention in one of its embodiments.

As shown in FIGS. 1, 2 and 3, the lock assembly includes an inner doorknob 10 and an outer doorknob 12, the two doorknobs being positioned on opposite sides of a door (not shown). The doorknobs 10 and 12 operate a spring-loaded dead bolt 16 through appropriate linkage to be described. A spring-loaded plunger 18 is also provided, with both the dead bolt and the plunger extending through a front plate 20 of the lock assembly. The front plate is secured to the edge of the door in which the mechanism shown in FIGS. 1, 2 and 3 is mounted.

Whenever either of the knobs 10 or 12 is turned, the dead bolt 16 is retracted against its spring pressure to its retracted position, so that the door may be opened. The dead bolt is held in its retracted position by a latch section of plunger 18. When the door is closed, however, plunger 18 moves against the striker plate mounted in the door frame and is retracted thereby. This action releases the dead bolt 16, and by spring action, the dead bolt is moved to its extended position, and into a cavity in the striker plate.

Figure 4A:
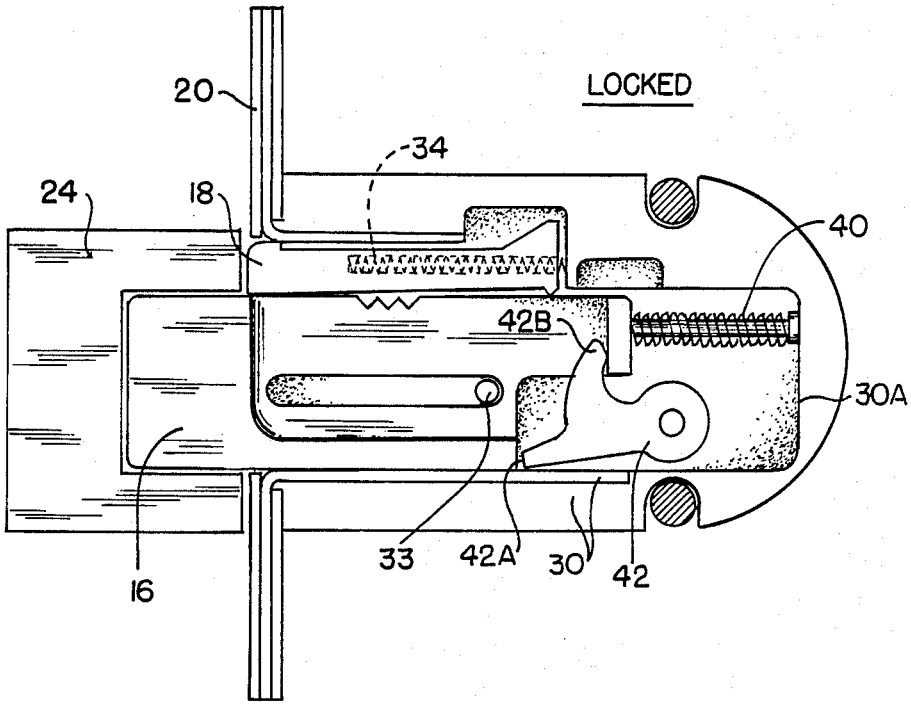
FIGS. 4A and 4B are sectional views, taken essentially along the line 4—4 of FIG. 3, and showing the internal components of the mechanism of the invention in a locked position with a dead bolt extended into a cavity in the striker plate of the door frame, and in an unlocked position with the dead bolt retracted and cocked.
Figure 4B:
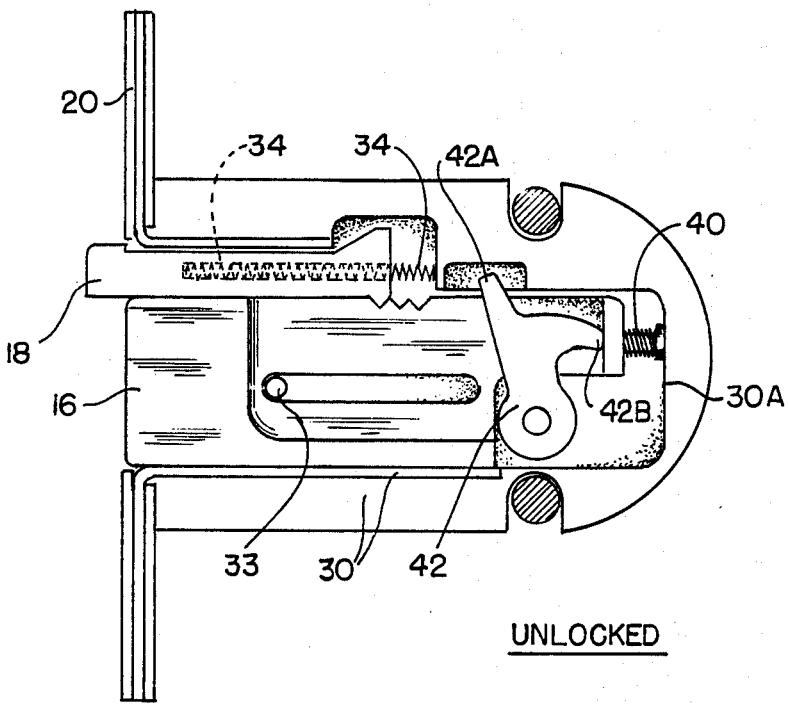

The mechanism in its locked position is shown in FIG. 4A, with the spring-loaded dead bolt 16 extended, and being received in a cavity in striker plate 24, and with plunger 18 engaging the side of the striker plate and being moved thereby to a retracted position. The mechanism is shown in its unlocked position in FIG. 4B, with the spring-loaded dead bolt retracted and latched. With reference now to FIGS. 4A and 4B, it will be seen that plunger 18 is slidably mounted within frame 30, and is spring-biased to its extended position by a spring 34.

The dead bolt 16 is also slidably mounted within frame 30, and is moved between its extended position of FIG. 4A, and its retracted position of FIG. 4B. The movement of the dead bolt is limited by a post 33 which extends into a slot in the dead bolt, as shown. The dead bolt is spring-biased in the forward direction to its extended position of FIG. 4A by a coil spring 40 which is received in the right-hand end of the dead bolt.

A crank 42 is pivotally mounted within the frame 30, and the crank is moved between its position shown in FIG. 4A, and its position shown in FIG. 4B, by turning either of the knobs 10 or 12. When the crank 42 is in the position shown in FIG. 4A, its end 42A is adjacent the rear end of dead bolt 20 and serves as a stop for the dead bolt. Any attempt to move the dead bolt to the right in FIG. 4A is prevented because of the engagement of the end of the dead bolt with the end 42A of crank 42.

When either knob is turned to open the door, crank 42 is turned in a clockwise direction from the position shown in FIG. 4A to the position shown in FIG. 4B. When the crank is so turned, its projection 42B engages the right-hand end of the dead bolt, and moves the dead bolt back against the pressure of the coil spring 40. The door may then be opened, releasing the plunger 18, which is biased to its extended position by coil spring 34, as showon in FIG. 4B.

The plunger is configured, so that when it is moved to its extended position, the upper part of its rear end engages frame 30, and causes the lower part of its rear end to be received in serrations in the dead bolt, as shown. The lower part of the rear end has a V-shape, so that it may be received in the serrations. The plunger now serves to latch the dead bolt in its retracted position, as shown in FIG. 4B.

However, when the door is next closed, the plunger 18 engages the striker plate 24, and is moved to its retracted position by the striker plate, as shown in FIG. 4A, releasing the dead bolt.

Several serrations are shown in the dead bolt, so that even if the dead bolt is only partially retracted by turning the knob, the plunger 18 will engage one of the other serrations, and will hold the dead bolt in its partially retracted position. In this way, when the striker 24 is sufficiently placed form the door to permit the door to be opened without fully retracting the dead bolt 20, the dead bolt will still be held in its partially retracted position by the plunger 18, so that if the door is slammed closed, the dead bolt will not strike against the door frame with possible damage, which could occur if the dead bolt were released when only partially retracted.

The invention provides, therefore, a rugged but simple door latch assembly which includes an improved mechanism that can be easily incorporated into existing doors, and which eliminates the latch, but provides a spring-biased dead bolt which is automatically thrown whenever the door is closed, and which is held firmly when in its thrown position until the doorknobs are subsequently turned.

It will be appreciated that while a particular embodiment of the invention has been shown and described, modifications may be made, and it is intended in the following claims to cover all modifications which fall within the true spirit and scope of the invention.

What is claimed is:

1. A door latch assembly comprising: at least one door knob; a frame; a dead bolt slidable in said frame between a retracted position and an extended position; first spring means engaging the dead bolt to move the dead bolt to its extended position with respect to the frame; and a plunger slidably mounted in said frame adjacent to said dead bolt and having a projection formed thereon engaging said dead bolt when said dead bolt is in its retracted position to retain the dead bolt in ints retracted position, said plunger extending outwardly from said frame and said dead bolt being released from said projection when the plunger is retracted into the frame relative to the dead bolt; second spring means engaging said plunger to bias the plunger to its extended position relative to the frame; and a crank rotatably mounted in said frame about an axis spaced axially from at least a portion of the rear end of the dead bolt, and coupled to the door knob, said crank having a projection positioned to engage the dead bolt to cause the dead bolt to be withdrawn from its extended position to its retracted position within said frame when the door knob is turned thereby turning the crank in a clockwise direction from a first angular position to a second angular position, and said crank having an end disposed adjacent to said portion of the rear end of the dead bolt when the crank is in its first angular position in which the crank is in substantial alignment with the dead bolt so as to serve as a stop for said dead bolt when the dead bolt is in its extended position so as to prevent the dead bolt from being forced back to its retracted position.

2. The door latch assembly defined in claim 1, in which said dead bolt has serrations in an edge thereof to receive said projection so as to cause the dead bolt to be retained in a plurality of retracted positions by said plunger.

* * * * *